US012059086B2

(12) United States Patent
Kay

(10) Patent No.: US 12,059,086 B2
(45) Date of Patent: Aug. 13, 2024

(54) CAKE SHIELD

(71) Applicant: William Kay, Boca Raton, FL (US)

(72) Inventor: William Kay, Boca Raton, FL (US)

( * ) Notice: Subject to any disclaimer, the term of this patent is extended or adjusted under 35 U.S.C. 154(b) by 947 days.

(21) Appl. No.: 16/990,652

(22) Filed: Aug. 11, 2020

(65) Prior Publication Data

US 2021/0369024 A1 Dec. 2, 2021

Related U.S. Application Data

(60) Provisional application No. 63/030,690, filed on May 27, 2020.

(51) Int. Cl.
*A47G 19/26* (2006.01)

(52) U.S. Cl.
CPC ..... *A47G 19/26* (2013.01)

(58) Field of Classification Search
CPC ..... A47G 19/26
USPC ..... 99/645
See application file for complete search history.

(56) References Cited

U.S. PATENT DOCUMENTS 2,203,540 A * 6/1940 Montgomery ..... A23G 3/28 D7/610
2,322,519 A * 6/1943 Ingebrigtsen ..... A47G 19/00 D7/553.6
2,347,041 A * 4/1944 Filsinger ..... B44F 11/00 D7/610
2,758,458 A * 8/1956 Carlson ..... A47G 19/26 D7/610
2,865,552 A * 12/1958 Sider ..... B65D 5/5445 229/125
4,219,119 A * 8/1980 Zefran ..... A47G 19/30 D7/610
4,461,790 A * 7/1984 Snider ..... B65D 85/60 D7/610
4,938,688 A * 7/1990 Wexler ..... A47G 19/26 D7/392.1
5,096,274 A * 3/1992 Fuschetto ..... A47G 19/26 312/284
5,582,478 A * 12/1996 Ambrosino ..... F21V 33/0056 362/276
5,927,266 A * 7/1999 Maugard ..... F24C 15/007 126/39 M
10,039,398 B1 * 8/2018 Daneshvar ..... F21V 35/00
10,463,180 B1 * 11/2019 Donnelly ..... A47G 19/02
11,116,341 B2 * 9/2021 Loar, Sr. ..... F21V 35/00
11,213,148 B1 * 1/2022 Payne ..... A47G 19/26
(Continued)

*Primary Examiner* — Omar Flores Sanchez
(74) *Attorney, Agent, or Firm* — The Rapacke Law Group, P.A.; Andrew S. Rapacke

(57) ABSTRACT

A cake shield with a top cover and side wall dimensioned to enclose a cake to prevent contamination during celebration is disclosed. Recesses in the top cover may include a recessed track dimensioned to hold multiple candles, a deeper cylindrical or conical recess, or a recess dimensioned for a candle with a rectangular footprint. Use of transparent material allows the cake to be viewed under the shield. The cake shield may comprise a base wall that supports the side wall of the top cover, and two or more pieces may interlock to form the base wall. A kit may also include a base plate for supporting both the cake and the side wall, as well as decorations for the top cover that may include candles and other materials.

18 Claims, 4 Drawing Sheets

(56) References Cited

U.S. PATENT DOCUMENTS

| | | | | |
|---|---|---|---|---|
| 11,686,468 | B1 * | 6/2023 | Lake | A21D 13/47 362/382 |
| 2005/0087459 | A1 * | 4/2005 | Slagter | A47G 19/26 206/227 |
| 2009/0053663 | A1 * | 2/2009 | Okros | A47G 19/26 431/295 |
| 2009/0181335 | A1 * | 7/2009 | Tropeano | F21S 13/14 431/295 |
| 2013/0248402 | A1 * | 9/2013 | Donnelly | F21V 35/00 431/295 |
| 2014/0224798 | A1 * | 8/2014 | Johnson | A47G 19/00 220/212 |
| 2019/0038056 | A1 * | 2/2019 | Pye | A47G 19/26 |
| 2019/0082870 | A1 * | 3/2019 | Kaupp | A47G 19/26 |
| 2019/0167021 | A1 * | 6/2019 | Jones | A47G 19/02 |
| 2019/0387908 | A1 * | 12/2019 | Leister | A47G 19/26 |
| 2020/0060454 | A1 * | 2/2020 | Mazzola | A47G 19/26 |
| 2020/0345164 | A1 * | 11/2020 | Loar, Sr. | F21V 35/00 |
| 2021/0219757 | A1 * | 7/2021 | Griffin, Jr. | F21V 35/00 |
| 2022/0034500 | A1 * | 2/2022 | Fogle | A47G 19/26 |
| 2022/0287487 | A1 * | 9/2022 | Fields, Sr. | A47G 19/26 |
| 2023/0200574 | A1 * | 6/2023 | Hernandez | F21V 35/00 206/291 |
| 2023/0225532 | A1 * | 7/2023 | Fogle | F21V 35/00 99/645 |

* cited by examiner

CAKE SHIELD

RELATED APPLICATIONS

This application claims priority to U.S. Provisional Patent Application Ser. No. 63/030,690, filed May 27, 2020, entitled "Cake Shield," and said patent application is herein incorporated by reference in its entirety to provide continuity of disclosure.

TECHNICAL FIELD

The embodiments provided herein relate to food storage and protection devices and, more particularly, relate to a cake cover and kit for preventing contamination of a cake when celebrating and blowing out candles.

BACKGROUND

Cakes are often decorated for birthdays, holidays, weddings, and other occasions. Many home bakers and bakeries decorate the exterior of a cake with icing designs for a particular theme. The theme may include imagery, writing, and edible or non-edible objects placed on the exterior of the cake to add a visually pleasing exterior to the cake.

Candles are often placed on a cake. Once lit, guests will typically sing and yell, and one or more people will blow on the candles to extinguish the flame. Some individuals have always been naturally inclined to avoid consuming a cake which may be contaminated, but recent public health issues have increased this concern.

In the current arts, cake covers exist for carrying cakes and helping to avoid unintentional contact; however, such cake covers are meant to be removed before insertion of candles, addition of other decorative features, and subsequent lighting and blowing.

There is need in the arts for a product that allows for celebration and blowing of candles, and which at the same time protects the cake until it is ready to be sliced and served.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The embodiments provided herein disclose a cake shield which generally embodies a top cover and a side wall that extends downward about the perimeter of the top cover, wherein the side wall and top cover define an interior space dimensioned to enclose a cake. The top cover comprises a top wall having a top surface, a bottom surface, a material thickness defined by the top surface and bottom surface, and a plurality of recesses dimensioned to hold candles or other decorations. The plurality of recesses have a depth greater than the material thickness of the top wall.

In one aspect, the cake shield further comprises a base wall, the top cover comprises the side wall, and the base wall is dimensioned to surround a cake and to support the side wall of the top cover. Often, at least the top cover and side wall are nestably stackable with matching parts of a second cake shield having the same structure. The cake shield may be at least partially comprised of transparent material so the decorated cake may be viewed under the shield. Two or more pieces may interlock to form the base wall. In another aspect, the side wall is the base wall.

Typically, at least one of the plurality of recesses is a recessed track dimensioned to hold multiple candles. Another is a cylindrical or conical recess having a depth greater than the depth of the recessed track. Yet another recess is dimensioned to hold multiple candles or one candle having a rectangular footprint. The recesses may have closed bottoms to prevent contamination through the cake shield.

The embodiments further disclose a kit for shielding and decorating a cake which generally comprises: a top cover comprising a top wall, a side wall extending downward about a perimeter of the top wall, a recessed track dimensioned to hold multiple candles, and a cylindrical or conical recess having a depth greater than the depth of the recessed track; a base wall comprised of two or more interlocking pieces and dimensioned to surround a cake and to support the side wall of the top cover, wherein the base wall and top cover define an interior space dimensioned to enclose a cake; and decorations to be placed on the top cover that may include candles and other inedible or edible materials.

In various embodiments and kits, the cake shield may include a base plate dimensioned to support both the cake and the side or base wall.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

A complete understanding of the present embodiments and the advantages and features thereof will be more readily understood by reference to the following detailed description when considered in conjunction with the accompanying drawings. The drawings described herein may not be to scale, are for illustrative purposes only of selected embodiments and not all possible implementations, and are not intended to limit the scope of the present disclosure.

For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings.

DETAILED DESCRIPTION

Figure 1:
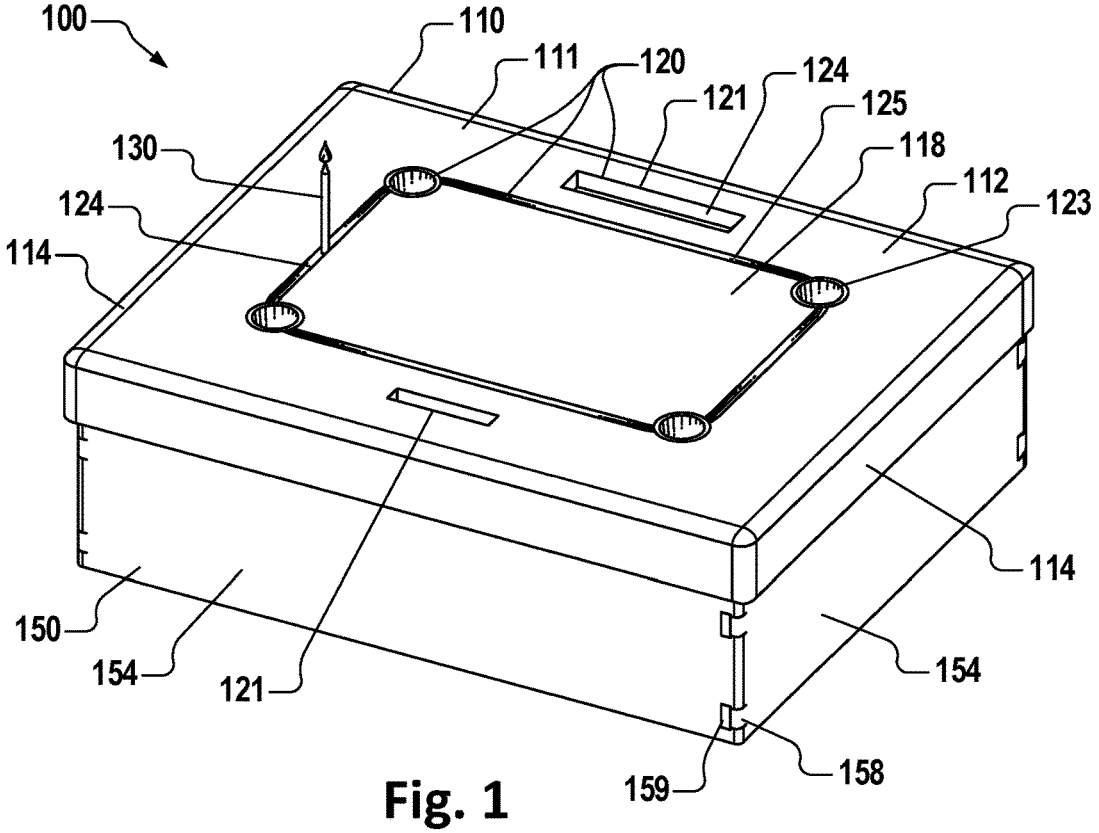
FIG. 1 illustrates a front perspective view of a cake shield, according to some embodiments.
Figure 2:
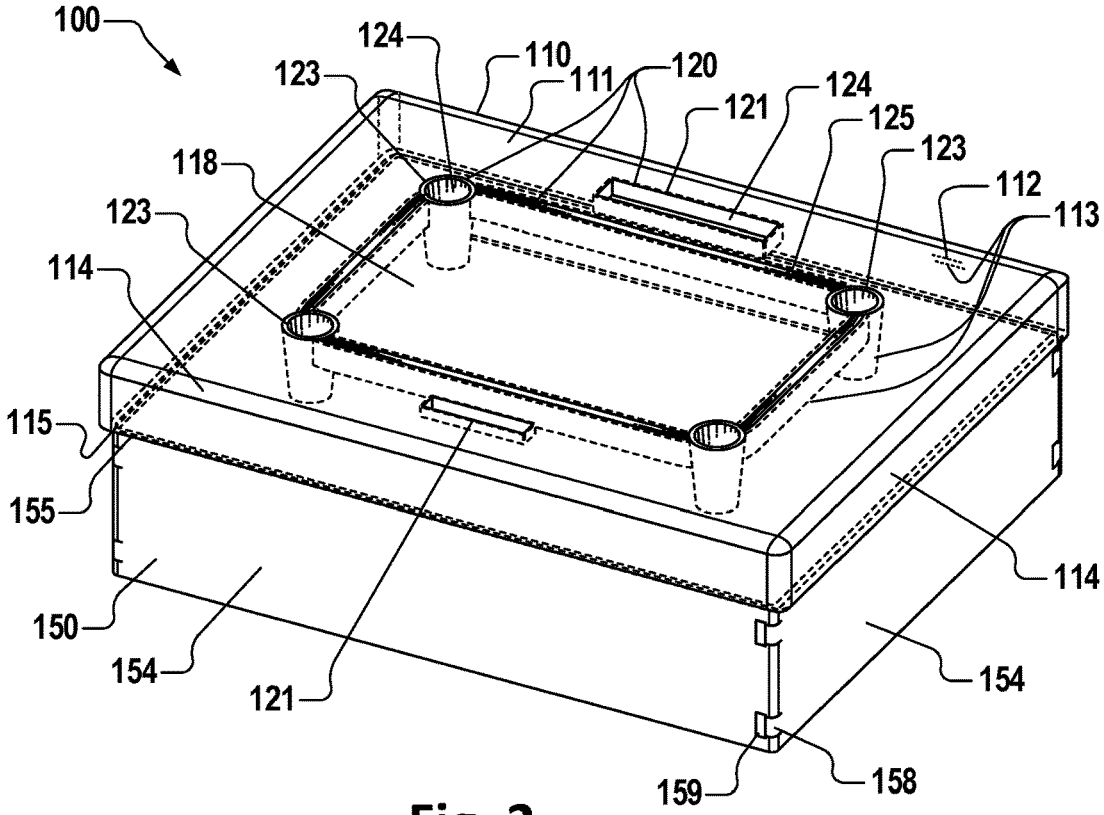
FIG. 2 illustrates a perspective view of the cake shield of FIG. 1 when comprising a transparent material, according to some embodiments.
Figure 3:
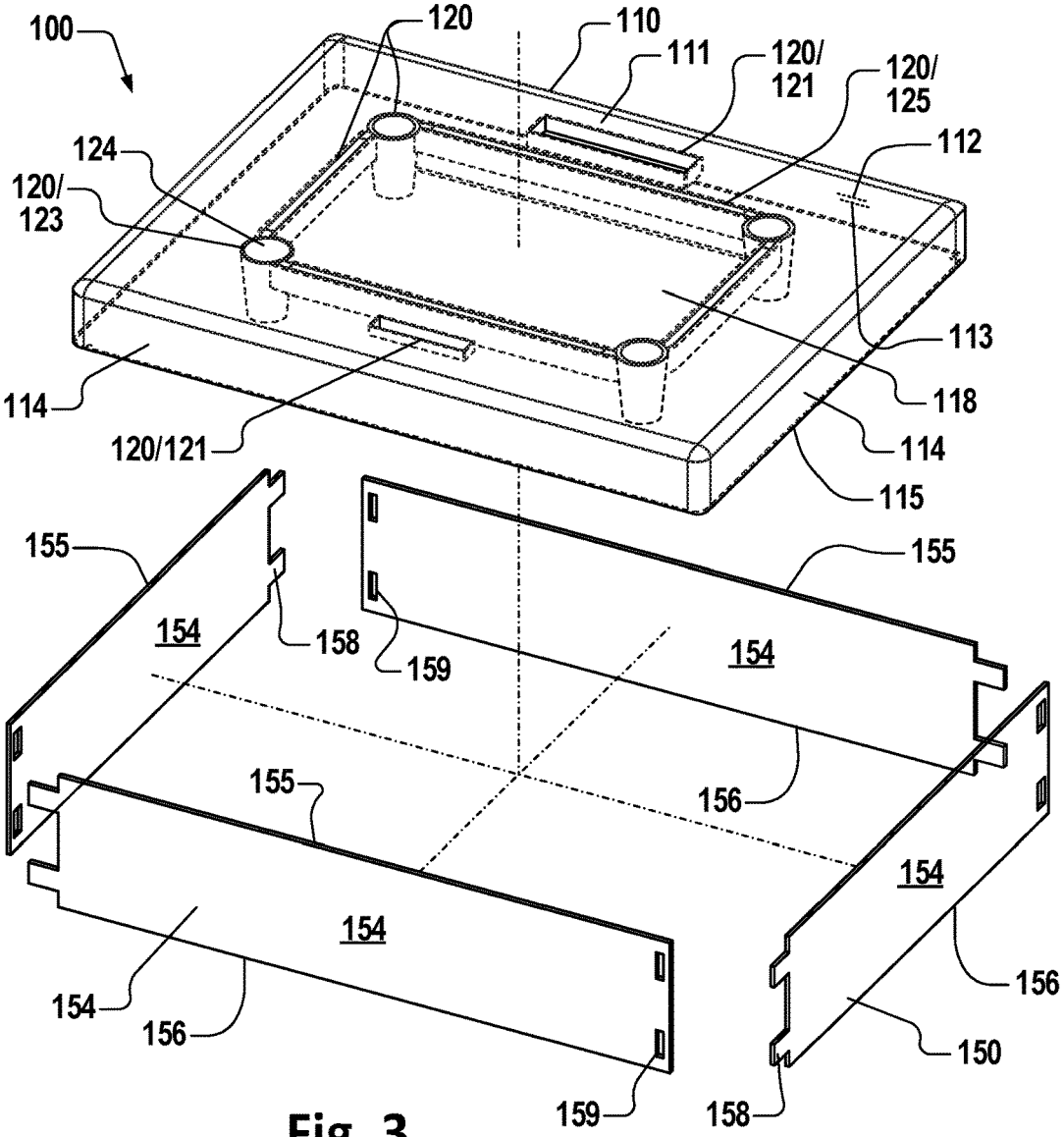
FIG. 3 illustrates an exploded view the cake shield of FIG. 2, according to some embodiments.

The specific details of the single embodiment or variety of embodiments described herein are to the described apparatus. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

With reference to FIGS. 1-9, a cake box, cover, or cake shield 100, which typically sells as a kit, is used to protect a cake (not shown) from contamination and other damage prior to consumption, particularly during a celebration and while candles are being blown out. In general, the cake shield 100 comprises a top cover 110 and one or more side walls 114, 154.

Figure 8:
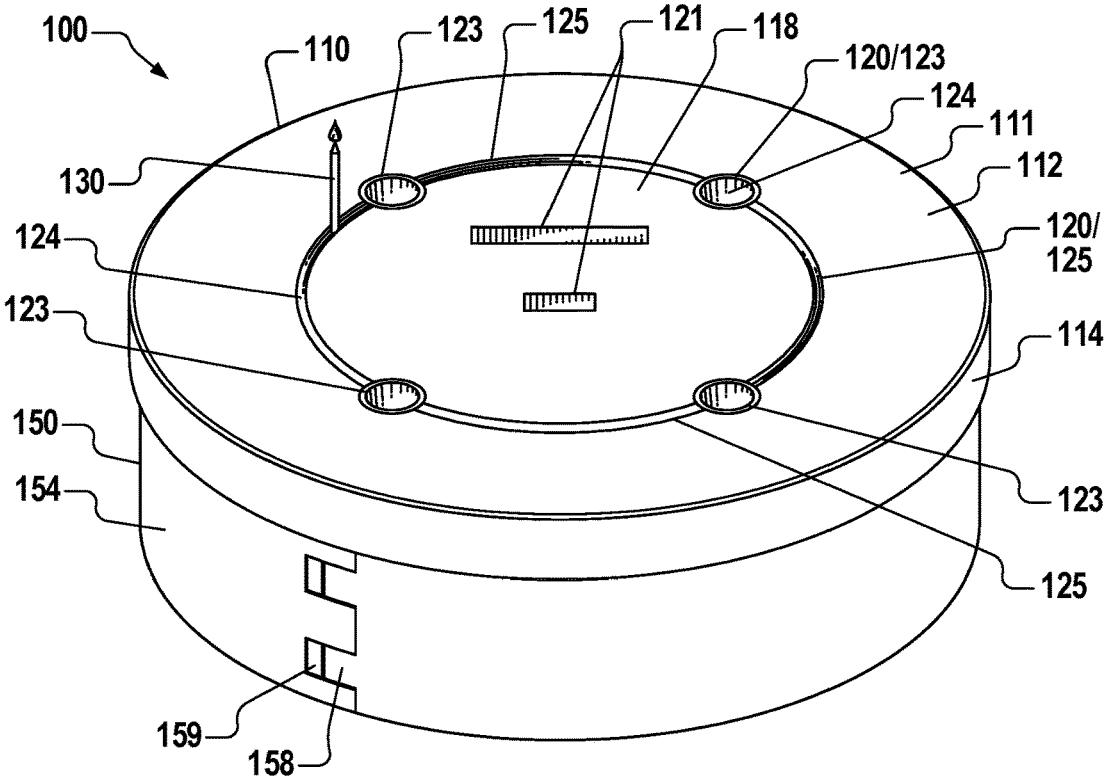
FIG. 8 illustrates a perspective view of a round cake shield, according to some embodiments.
Figure 9:
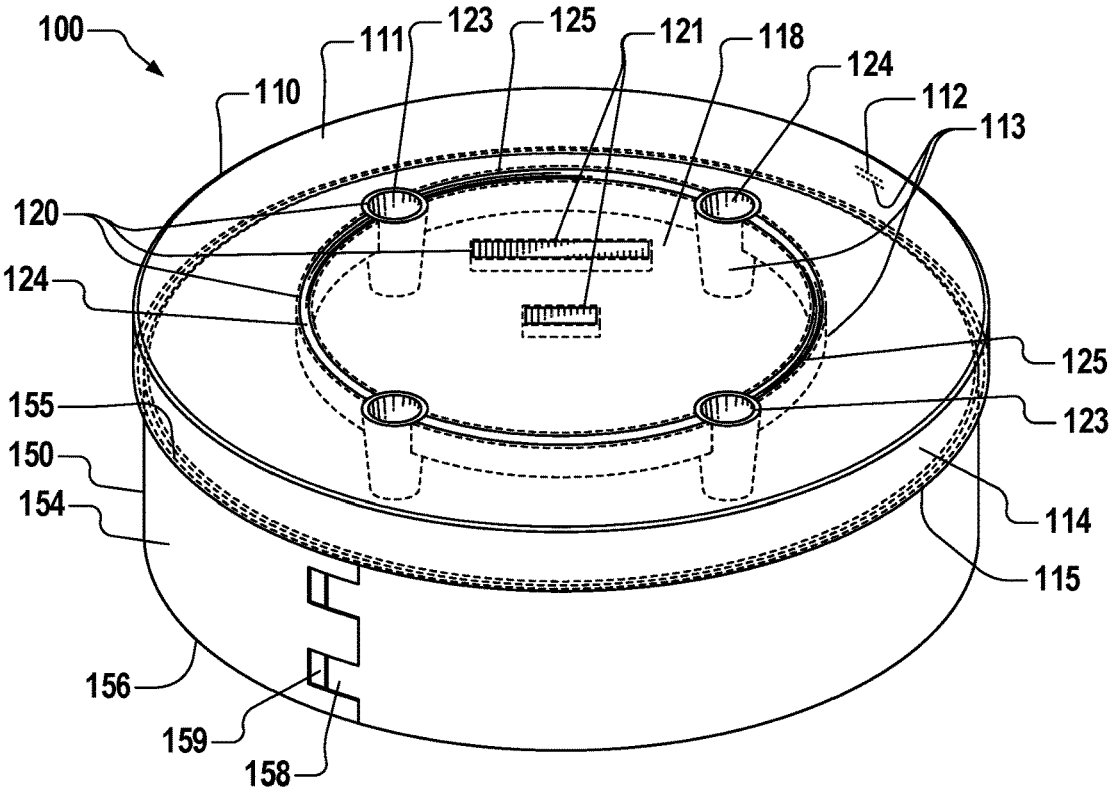
FIG. 9 illustrates the perspective view of the cake shield of FIG. 8 when comprising a transparent material, according to some embodiments.

As shown in the opaque embodiments of FIGS. 1 and 8, cake shield 100 comprises top cover 110, which rests on base wall 150. Top cover 110 comprises top wall 111, side wall 114, top surface 112, bottom surface 113, and a plurality of recesses 120 dimensioned to hold a variety of decorations 130. Decorative print may also be placed on these parts, though a preferred embodiment is constructed of transparent plastic so the cake, its icing, and decorations 130 on the top cover 110 receive the attention. Semi-transparent, colored, or non-colored materials may also be used.

In reference to FIGS. 2-9, recesses 120 on the top cover 110 are located across a substantial portion of the top wall 111 to maximize decorating flexibility. Each recess 120 is defined, at least in part, by the intersection of its interior wall(s) 124 with the top wall 111. In one configuration, four cups, pillars, or protrusions 123 are recesses 120 located at the corners of a central plate 118 around which a recessed track 125 (120) runs. There may be fewer or more than four protrusions 123, and the recessed track 125 is not limited to a rectangular or circular shape. These recesses 120 are also not limited to a symmetrical placement, nor must they be in line with each other. Other recesses 121 (120) illustrated herein as horizontal may hold decorations 130, such as numerical birthday candles (for example, a candle shaped like a "2"). Such recesses 121 may be proximate of a perimeter of the top wall 111, on the central plate 118, or a combination thereof. A recess 120 on the central plate 118 may be large enough to form a tray. The recessed track 125 may be dimensioned to frictionally hold a standard birthday candle 130, or the recessed track 125 may be wider so it holds various candle sizes, candies, and other decorations 130.

Protrusions 123 are typically dimensioned to hold tapered candles, flower buds, and other larger decorations 130. Although the protrusions 123 will rarely contact the cake below the top cover 110, they do provide a structural support that will help keep the top cover 110 from inadvertently being pushed into whatever decorations have been placed on the cake itself. Thus, the protrusions 123 do not purposely insert into and damage the cake. The protrusions 123 may be cylindrical or otherwise shaped, but are preferably conical such that top cover 110 is nestably stackable with other top covers of the same design, to aid in storage, shipping, and manufacturing with molds.

Figure 4:
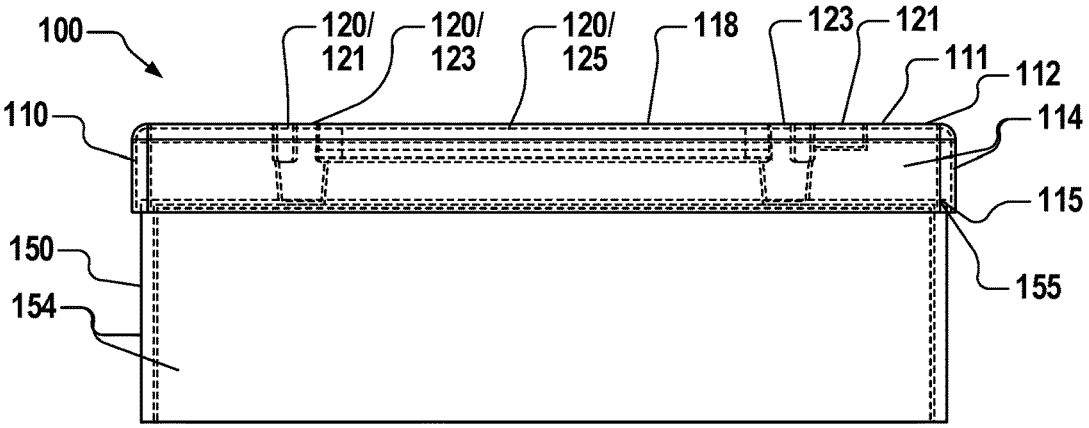
FIG. 4 illustrates a right side view of the cake shield of FIG. 2, according to some embodiments.
Figure 5:
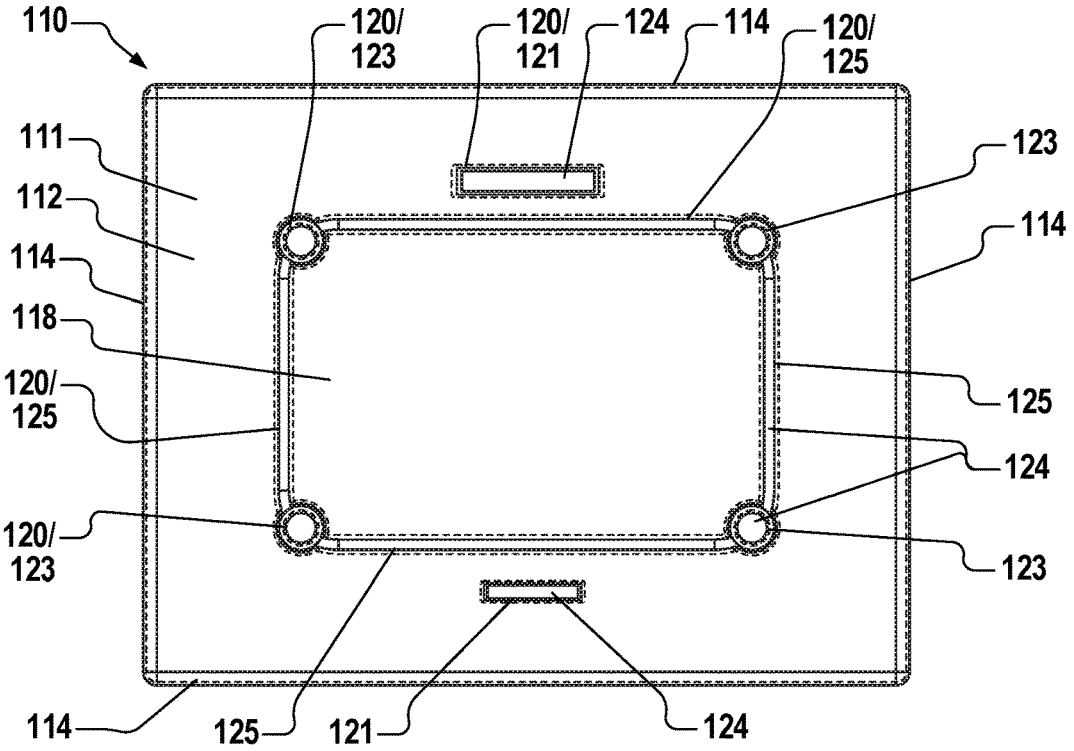
FIG. 5 illustrates a top view of a top cover of a cake shield, according to some embodiments.

In general, the thickness of the material that makes up the top wall 111 is defined by the distance between the top wall's 111 top surface 112 and bottom surface 113. The multiple recesses 120 have interior walls 124 and depths greater than the thickness of the material of the top wall 111. Protrusions 123 usually have a greater depth than that of the recessed track 125. As shown in FIG. 4, the protrusions 123 typically have a depth equal to or less than the height of the side wall(s) 114 of the top cover 110. Recesses 120 are preferably closed at the bottom surface 113 in order to prevent the cake from being contaminated through the recesses 120. Recesses 120 are not limited to the number, shapes, depths, or placements shown.

Figure 6:
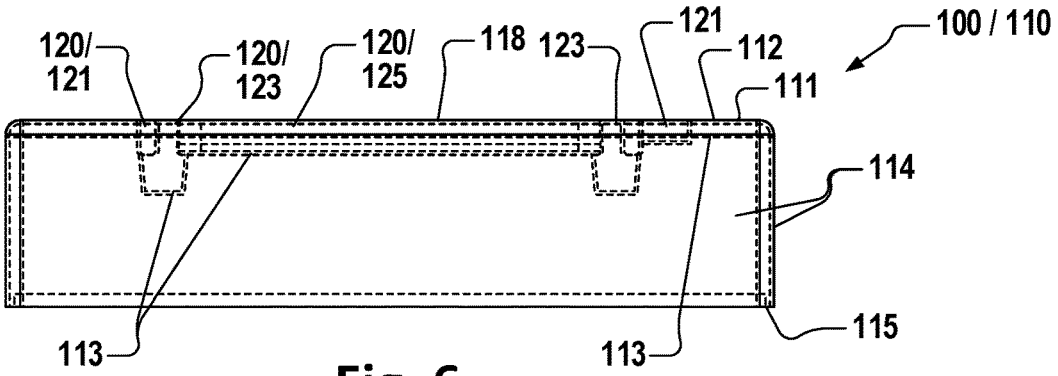
FIG. 6 illustrates a right side view of a top cover of a cake shield having taller side walls, according to some embodiments.
Figure 7:
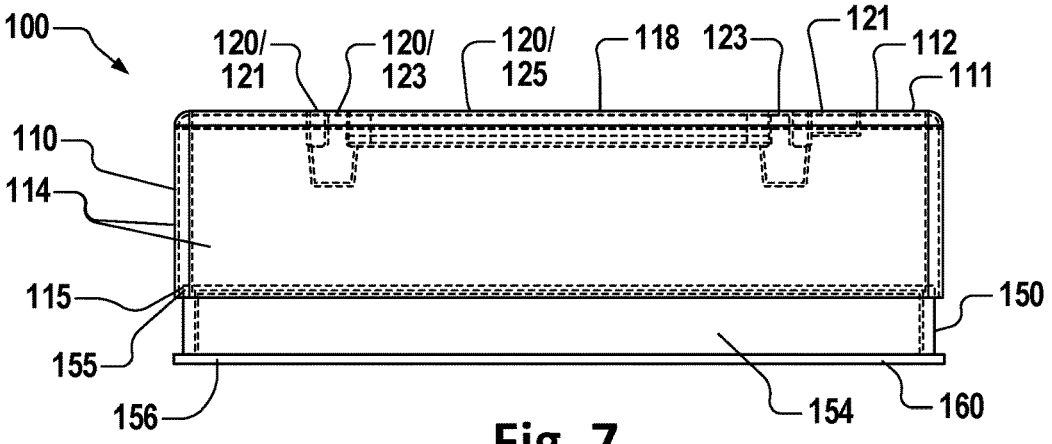
FIG. 7 illustrates a cake shield with the top cover of FIG. 6, according to some embodiments.

Base wall 150 comprises one or more wall pieces 154, each having a top edge 155 and a bottom edge 156. FIGS. 4, 6, and 7 are illustrated with one uniform wall piece 154 without tabs. In the remaining Figures, when one or more tabbed wall pieces 154 are employed, they mate end to end and interlock to create an enclosed space that will house the cake. In a preferred embodiment, one end of each piece 154 comprises at least one tab 158, and the other end comprises at least one slot 159. The tab 158 may be thinner or more flexible than the rest of the wall piece 154 in order to be fitted into the cooperating slot 159 and to permit the completed base wall 150 to form a particular shape. As shown more particularly in FIG. 3, a rectangular base wall 150 may be comprised of four wall pieces 154 and placed around a cake (not shown) with bottom edge 156 sitting on a supporting surface. Top edge 155 interfaces with the top cover's side wall 114 at its lower edge 115 (see FIGS. 4 and 7). A seamless connection between the base wall 150 and side wall 114 may be made via a grooved edge, ledge, or other structure with comparable fit and support. As with the top cover 110, the one or more wall pieces 154 are not limited to forming a rectangular or circular shape. FIG. 7 further illustrates that the cake shield 100 may comprise a serving tray or base plate 156 that supports the cake and base wall 150, especially during transportation. All wall connections are preferably releasable attachments for easy removal of the top cover 110 without damage to the cake and for disassembling the base wall 150 for cleaning and reuse or disposal.

FIGS. 6 and 7 present an embodiment of the top cover 110 with a tall side wall 114 with greater interior space beneath the protrusions 123. The taller top cover 110 may be used alone as a cake shield 100 over a thin sheet cake or in conjunction with a regular or short base wall 150 as shown in FIG. 7. One skilled in the arts will readily understand that the total height of the side of the shield 100 is achieved through a combination of the height of the top cover side wall 114 and the height of the base wall 150. Either height may be maximized or minimized, and the term "side wall" may refer to the top cover side wall 114, the base wall 150, or a combination of the two. One skilled in the arts will also understand that with many molding processes, the top wall 111 and side wall 114 will share a rounded corner.

A kit for a cake shield 100 generally includes a top cover 110, a base wall 150 that comprises wall pieces 154, and optionally a base plate 156 and/or decorations 130. The decorations 130 may include, but are not limited to: candles; banners or other printed or unprinted pieces made of paper, plastic, or other materials for birthdays, weddings, and other such celebrations; artificial flowers; figurines or toys; candy; and icing.

In practice, the user places a cake on a surface such as the base plate 156, assembles and sets the base wall 150 around the cake on the surface, encloses the cake with the top cover 110, and places the various decorations 130. After candles are blown out and celebrants finish singing, the cake shield 100 is disassembled in reverse order, and a pristine cake is served free of contamination from the celebration. The cake shield 100 is beneficial for a pandemic or flu season, for sensitive populations, and for everyday use.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A cake shield, comprising:

a top cover comprising a top wall having a top surface, a bottom surface, a material thickness defined by the top surface and bottom surface, and a plurality of recesses dimensioned to hold candles or decorations, wherein the plurality of recesses have a depth greater than the material thickness of the top wall; and a side wall that extends downward about the perimeter of the top cover, wherein the side wall and top cover define an interior space dimensioned to enclose a cake, wherein at least one of the plurality of recesses is a recessed track dimensioned to hold multiple candles and comprises at least one cylindrical or conical recess having a depth greater than the depth of the recessed track.

2. The cake shield of claim 1, further comprising a base wall, wherein the top cover comprises the side wall, and wherein the base wall is dimensioned to surround a cake and to support the side wall of the top cover.

3. The cake shield of claim 2, wherein the base wall comprises two or more pieces that interlock to form the base wall.

4. The cake shield of claim 1, wherein the side wall is a base wall upon which the top cover rests, and the base wall is dimensioned to surround a cake and to support the top cover.

5. The cake shield of claim 4, wherein the base wall comprises two or more pieces that interlock to form the base wall.

6. The cake shield of claim 1, wherein at least one of the plurality of recesses is dimensioned to hold multiple candles or at least one candle having a rectangular footprint.

7. The cake shield of claim 1, wherein the plurality of recesses have closed bottoms.

8. The cake shield of claim 1, further comprising a base plate dimensioned to support the cake and the side wall.

9. The cake shield of claim 1, wherein the cake shield is at least partially comprised of a transparent material.

10. The cake shield of claim 1, wherein at least the top cover and side wall are nestably stackable with matching parts of a second cake shield having the same structure.

11. A cake shield, comprising:

a top cover comprising a top wall, a side wall extending downward about a perimeter of the top wall, a recessed track dimensioned to hold multiple candles, and a cylindrical or conical recess having a depth greater than the depth of the recessed track; and a base wall comprised of two or more interlocking pieces and dimensioned to surround a cake and to support the side wall of the top cover;

wherein the base wall and top cover define an interior space dimensioned to enclose a cake.

12. The cake shield of claim 11, wherein the recessed track and the cylindrical or conical recess have closed bottoms.

13. The cake shield of claim 11, further comprising a base plate dimensioned to support the cake and the base wall.

14. The cake shield of claim 11, wherein the cake shield is at least partially comprised of a transparent material.

15. The cake shield of claim 11, wherein at least the top cover and side wall are nestably stackable with matching parts of a second cake shield having the same structure.

16. A kit for shielding and decorating a cake, the kit comprising:

a top cover comprising a top wall, a side wall extending downward about a perimeter of the top wall, a recessed track dimensioned to hold multiple candles, and a cylindrical or conical recess having a depth greater than the depth of the recessed track;

a base wall comprised of two or more interlocking pieces and dimensioned to surround a cake and to support the side wall of the top cover, wherein the base wall and top cover define an interior space dimensioned to enclose a cake; and decorations to be placed on the top cover that may include candles and ether inedible or edible materials.

17. The kit of claim 16, further comprising a base plate dimensioned to support the cake and the base wall.

18. The kit of claim 16, wherein at least the top cover and side wall are nestably stackable with matching parts of a second cake shield having the same structure.

* * * * *